US008244168B2

(12) United States Patent
Ehara et al.

(10) Patent No.: US 8,244,168 B2
(45) Date of Patent: Aug. 14, 2012

(54) IMAGE FORMING APPARATUS WITH MOVABLE TRANSFER DEVICE

(75) Inventors: Masanao Ehara, Zama (JP); Hiroshi Yoshinaga, Ichikawa (JP); Naoki Iwaya, Kawasaki (JP); Yoshiki Yamaguchi, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 847 days.

(21) Appl. No.: 12/213,683

(22) Filed: Jun. 23, 2008

(65) Prior Publication Data

US 2008/0317532 A1 Dec. 25, 2008

(30) Foreign Application Priority Data

Jun. 25, 2007 (JP) ..... 2007-165774
Nov. 13, 2007 (JP) ..... 2007-294285

(51) Int. Cl.
*G03G 15/00* (2006.01)
*G03G 15/08* (2006.01)
*G03G 15/16* (2006.01)

(52) U.S. Cl. ..... 399/400; 399/110; 399/121; 399/122; 399/126

(58) Field of Classification Search ..... 399/400
See application file for complete search history.

(56) References Cited

U.S. PATENT DOCUMENTS 5,124,759 A * 6/1992 Fukuchi et al. ..... 399/22
5,802,426 A * 9/1998 Miyazaki et al. ..... 399/113
6,219,520 B1 4/2001 Ehara
6,343,198 B1 * 1/2002 Sato ..... 399/121
6,600,885 B2 * 7/2003 Kida ..... 399/124
6,628,916 B2 9/2003 Yasui et al.
6,636,709 B2 10/2003 Furukawa et al.
6,775,495 B2 * 8/2004 Kida ..... 399/124
6,775,496 B2 * 8/2004 Kida ..... 399/124
6,778,790 B2 8/2004 Yoshinaga et al.
6,778,804 B2 8/2004 Yoshinaga et al.
6,785,505 B2 8/2004 Yasui et al.
6,788,910 B2 * 9/2004 Kida ..... 399/124
6,807,386 B2 10/2004 Yasui et al.
6,881,927 B2 4/2005 Yoshinaga et al.
6,882,820 B2 4/2005 Shinshi et al.
6,892,044 B2 5/2005 Yasui et al.
7,022,944 B2 4/2006 Yoshinaga et al.
7,127,204 B2 10/2006 Satoh et al.

(Continued)

FOREIGN PATENT DOCUMENTS

CN 1175717 3/1998

(Continued)

OTHER PUBLICATIONS

Machine translation of JP2007-298695.*

(Continued)

*Primary Examiner* — David Gray
*Assistant Examiner* — David Bolduc
(74) *Attorney, Agent, or Firm* — Harness, Dickey & Pierce, P.L.C.

(57) ABSTRACT

An image forming apparatus includes a transfer device that transfers a toner image formed on an image bearer onto a transfer sheet and a fixing device that fixes the toner image onto the transfer sheet. The transfer device is freely movable between an operational position and a non-operational position and includes a contacting section that directly contacts the fixing device and determines a position of the transfer device.

5 Claims, 11 Drawing Sheets

U.S. PATENT DOCUMENTS

| | | | | |
|---|---|---|---|---|
| 7,151,907 | B2 | 12/2006 | Yoshinaga | |
| 7,221,895 | B2 * | 5/2007 | Omata et al. | 399/302 |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,379,698 | B2 | 5/2008 | Yoshinaga | |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0118367 | A1 * | 6/2003 | Omata et al. | 399/110 |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2004/0042825 | A1 | 3/2004 | Yasui et al. | |
| 2005/0025539 | A1 | 2/2005 | Yoshinaga et al. | |
| 2005/0095043 | A1 | 5/2005 | Yoshinaga et al. | |
| 2005/0129432 | A1 | 6/2005 | Sato et al. | |
| 2005/0163543 | A1 | 7/2005 | Satoh et al. | |
| 2005/0180786 | A1 | 8/2005 | Yamada et al. | |
| 2006/0013612 | A1 * | 1/2006 | Shoji | 399/111 |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0177232 | A1 | 8/2006 | Ehara et al. | |
| 2006/0257183 | A1 | 11/2006 | Ehara et al. | |
| 2007/0014603 | A1 | 1/2007 | Satoh et al. | |
| 2007/0059036 | A1 * | 3/2007 | Yamada et al. | 399/116 |
| 2007/0110476 | A1 * | 5/2007 | Lee et al. | 399/121 |
| 2007/0166083 | A1 | 7/2007 | Satoh et al. | |
| 2007/0248391 | A1 * | 10/2007 | Yokokawa et al. | 399/400 |
| 2008/0063443 | A1 | 3/2008 | Yoshinaga et al. | |
| 2008/0187343 | A1 * | 8/2008 | Yamaguchi et al. | 399/74 |

FOREIGN PATENT DOCUMENTS

| | | | |
|---|---|---|---|
| JP | 06-180538 | | 6/1994 |
| JP | 06-183627 | | 7/1994 |
| JP | 2001-109215 | | 4/2001 |
| JP | 2002-268301 | | 9/2002 |
| JP | 3452290 | | 7/2003 |
| JP | 2003-307944 | | 10/2003 |
| JP | 2005-292612 | | 10/2005 |
| JP | 2006-258935 | | 9/2006 |
| JP | 2007-079319 | | 3/2007 |
| JP | 2007178879 | A * | 7/2007 |
| JP | 2007298695 | A * | 11/2007 |

OTHER PUBLICATIONS

Machine translation of JP 2007178879 A.*

Abstract of JP 09-068871 published Mar. 11, 1997.

Notice issued for corresponding Japanese patent application No. 2007-165774 on Dec. 19, 2011.

Office Action issued on Jan. 8, 2010 for corresponding Chinese patent application No. 2008101306216.

Office Action issued on Mar. 9, 2012 for corresponding Japanese patent application No. 2007-294285.

* cited by examiner

IMAGE FORMING APPARATUS WITH MOVABLE TRANSFER DEVICE

CROSS REFERENCE TO RELATED APPLICATIONS

This application claims priority under 35 USC §119 to Japanese Patent Application Nos. 2007-165774 and 2007-294285, filed on Jun. 25, 2007, and Sep. 13, 2007, respectively, the entire contents of which are hereby incorporating by reference.

BACKGROUND OF THE INVENTION

1. Field of the Invention

This invention relates to an image forming apparatus, such as a copier, a printer, a plotter, a multifunction machine including functions of those, and in particular to an electro-photographic image forming apparatus capable of forming a toner image on a photoconductive member by charging, writing, developing, transferring the toner image either directly or indirectly via an intermediate transfer member using a transfer device, on a transfer medium, such as a sheet, etc., and fixing the toner image using a fixing device.

2. Discussion of the Background Art

The image forming apparatus generally records an image including character and symbol or the like on a transfer medium, such as a sheet, a cloth, an overhead projector film, etc., based on image information. Among various image forming systems, an electro-photographic image forming apparatus widely spreads due to high-speed and fine image printing on a plain paper.

In such an electro-photographic image forming apparatus, a charging device, a writing device, a developing device, a transferring device, a cleaning device, and a charge removing device are arranged around a drum shape belt type photoconductive member. When the surface of the photoconductive member is uniformly charged as the photoconductive member rotates, a writing process is executed and a latent image is formed thereon. Then, a toner image is formed by adding toner and developing the latent image. The toner image is then either directly or indirectly transferred via an intermediate transfer member, such as a belt, etc., on a transfer medium.

The transfer medium is lead to the fixing device after the toner image transfer process, and an unfixed toner image is fixed onto the transfer medium. The surface of the photoconductive member is cleaned by a cleaning device after the image transfer process, while charge remaining thereon is removed, thereby the next image formation becomes standby.

In this type of electro-photographic image forming apparatus, an optional relation between the transfer device and the fixing device is very important, because the relation largely affects conveyance quality, such as transfer medium curls, winkle, etc., and image quality, such as precision of color superimposition of toner images.

Then, the transfer device and the fixing device are conventionally supported by an image forming apparatus body, so that precision of attachment of these devices can be maintained with reference to the body, and a parallel degree between those devices can be adjusted during a manufacturing process while size precision is severely checked.

However, even if the parallel degree is strictly adjusted, curls or winkle occurs depending on various usage conditions at a user site or a toner image creates color deviation or the other problem. Further, as a cost of an image forming apparatus is decreasingly recently, adjustment of the parallel degree and strict adjustment of the size precision of those devices results in cost increase.

SUMMARY OF THE PRESENT INVENTION

Accordingly, an object of the present invention is to improve such background art technologies and provides a new and novel image forming apparatus. Such a new and novel image forming apparatus includes a transfer device that transfers a toner image formed on an image bearer onto a transfer sheet and a fixing device that fixes the toner image onto the transfer sheet. The transfer device is freely movable between an operational position and a non-operation position and includes a contacting section that contacts the fixing device and determines a position of the transfer device.

In another embodiment, a transfer section outlet guide member is provided to guide a transfer medium when the transfer medium is launched from a transfer device after an image transfer process. A fixing section inlet guide member is provided to guide the transfer medium when the transfer medium is fed through a transfer section outlet guide member and is launched into the fixing device.

In yet another embodiment, a position of each of the transfer section outlet guide member and the fixing section inlet guide member is adjustable.

In yet another embodiment, the transfer section outlet guide member and the fixing section inlet guide member are linked to each other.

In yet another embodiment, a position of each of the transfer section outlet guide member and the fixing section inlet guide member is adjustable in accordance with a sheet feeding condition.

In yet another embodiment, a position of each of the transfer section outlet guide member and the fixing section inlet guide member is adjustable in accordance with a type of a transfer medium.

In yet another embodiment, a position of each of the transfer section outlet guide member and the fixing section inlet guide member is adjustable in accordance with installation environment of the image forming apparatus.

In yet another embodiment, a position of each of the transfer section outlet guide member and the fixing section inlet guide member is adjustable in accordance with an image condition of the transfer medium.

In yet another embodiment, a fine adjustment device is provided to finely adjust parallel degree between the transfer position and the fixing position. One of the transfer device and the fixing device includes a contacting section and the other one of transfer device and the fixing device includes a contacted section. Relative positioning between the transfer device and the fixing device is determined when the contacting section contacts the contacted section.

In yet another embodiment, a supporting member supports the fixing device. The fine adjustment device is located between the fixing device and a supporting frame supporting the fixing device.

In yet another embodiment, a drive force-transmitting device is provided to transmit a drive force to the fixing device. The fine adjustment device is disposed on the opposite side of the drive force-transmitting device.

In yet another embodiment, the parallel degree is finely adjusted in both directions in parallel and vertical to the surface of the recording medium.

In yet another embodiment, the parallel degree is finely adjusted in the direction vertical to the surface of the recording medium by contacting the contacting section to the contacted section.

In yet another embodiment, the parallel degree is finely adjusted in the direction in parallel to the surface of the recording medium between the fixing device and the supporting frame.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
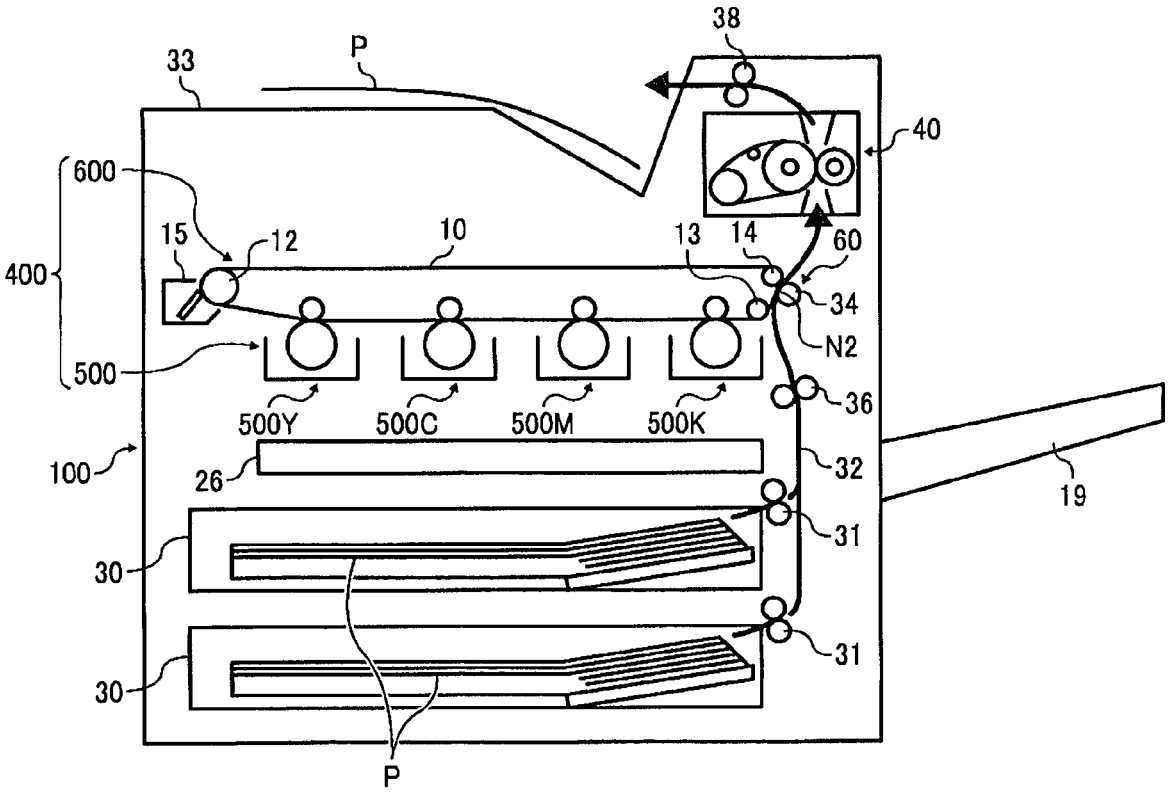
FIG. 1 schematically illustrates an exemplary tandem type color printer as one example of an electro-photographic image forming apparatus, to which the present invention is applied.
Figure 2:
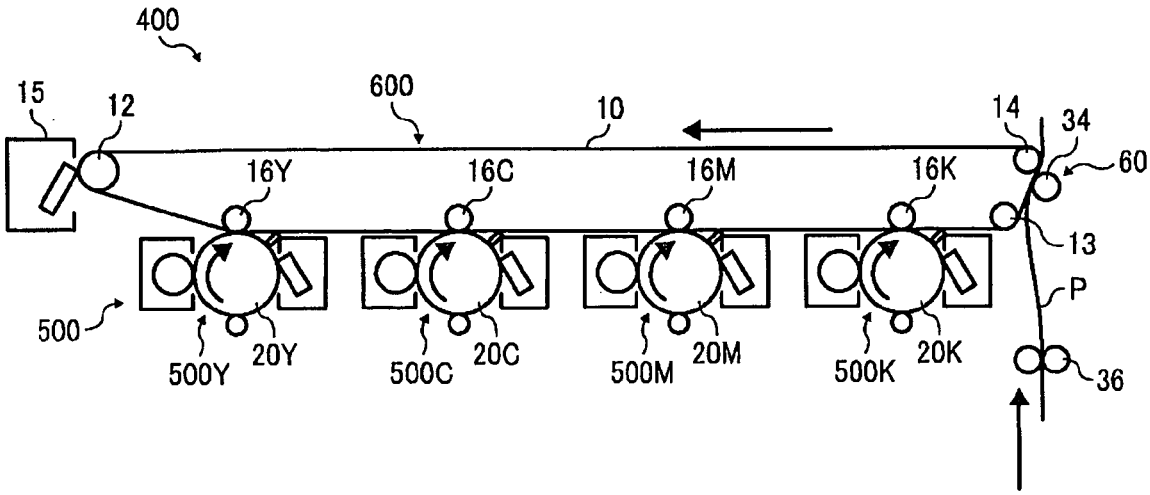
FIG. 2 illustrates an exemplary image forming device included in the tandem type color printer of FIG. 1.

Referring now to the drawing, wherein like reference numerals designate identical or corresponding parts throughout several views, in particular in FIG. 1, an exemplary tandem type color printer as one example of an electro photographic image forming apparatus is generally described. In a printer body 100, an image forming device 400 is installed. As shown in FIG. 2, the image forming device 400 includes four image forming units 500 for yellow (Y), cyan (C), magenta (M), and black (K) and an intermediate transfer unit 600. These units 500 and 600 are detached to the body. In the intermediate transfer unit 600, an intermediate transfer belt 10 serving as an intermediate transfer member is wound around three rollers 12 to 14 and includes a belt cleaning device 15 on the left side in the drawing.

Figure 3:
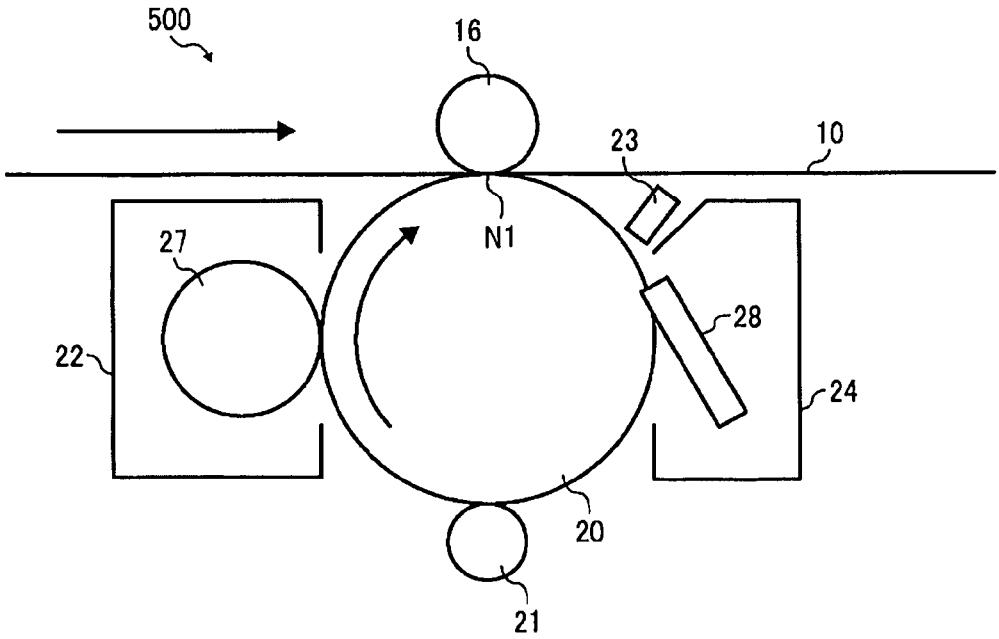
FIG. 3 illustrates an exemplary image forming unit included in the image forming device of FIG. 2.

The four image forming units 500K, 500M, 500Y, and 500C include the same configuration to each other and different color toner. These four image forming units are arranged below the intermediate transfer unit 600 along the run of the intermediate transfer belt 10. One of the image forming units 500 is schematically illustrated in FIG. 3.

Each of the image forming units 500 includes a drum type photoconductive member 20, a discharge device 21, a developing device 22, a primary transfer device 16 having a transfer roller arranged across the intermediate transfer belt 10, a charge removing device 23, such as a lamp, and a cleaning device 28 or the like are arranged around a photoconductive member 20.

The discharge device 21 uniformly discharges the surface of the photoconductive member 20 while contacting the photoconductive member 20 and applying a voltage. However, a brush or a scorotron charging system can be employed instead of the discharge device 21. The developing device 22 includes a stirring section and a developing section so that developer not used in development is returned to the stirring section to be reused. Density of toner is detected at the stirring section by a toner density sensor and is controlled to be constant.

The primary transfer device 16 employs transfer rollers 16Y to 16K pressure contacting the respective photoconductive members 20Y, 20C, 20M, and 20K via the intermediate transfer belt 10 as shown in FIG. 2. As the primary transfer device 16, a conductive brush and a non-contact corona charger or the like can be employed.

A writing device 26 is arranged below the image-forming device 400 as shown in FIG. 1 to form a latent image on the photoconductive members 20 installed in the respective image forming units 500 in accordance with image information read by a scanner, for example.

As the photoconductive member 20 rotates clockwise in FIG. 3, the discharge device 21 uniformly charges the surface of the photoconductive member 20. A writing beam is emitted from the writing device 26 in accordance with image signals and forms a latent image on the photoconductive member 20. Then, a developing sleeve 27 in the developing device 22 applies toner to the photoconductive member 20. The toner attracted to the photoconductive member 20 is transferred onto the intermediate transfer belt 10 by a primary transfer device 16 at a primary transfer position N1.

The toner not transferred and remaining on the photoconductive member 20 receives charge removal from the charge removing device 23 while a surface potential is initialized. The toner is then scraped off by the cleaning member 28, such as a cleaning blade, in the drum cleaning device 24, thereby the next image formation is standby. The toner collected by the drum cleaning device 24 is further collected by a collection screw or a toner recycle device, not shown, to the developing device 22 to be reused there.

As shown in FIG. 1, plural sheet feed trays 30 of multiple steps are disposed below the writing device 26. Each of the sheet-feed trays 30 includes a sheet-feeding device 31 for launching transfer mediums accommodated therein one by one. A conveyance path 32 is arranged to convey the transfer medium launched by the sheet-feeding device 31. The conveyance paths 32 starting from each of the sheet feed trays 30 join and upwardly extend until an ejection sheet stack section 33 arranged on the printer body 100.

A secondary transfer roller 34 of the secondary transfer device 60 is arranged in the conveyance path 32 opposing the intermediate transfer unit 600, thereby forming a secondary transfer position N2 therebetween. A pair of registration rollers 36 are arranged upstream of the secondary transfer position N2. A fixing device 40 is arranged downstream of the secondary transfer position N2. A pair of sheet ejection rollers 38 are arranged further downstream of the fixing device 40. Instead of the secondary transfer roller 34, either a transfer belt of a transfer charger can be employed.

As the intermediate transfer belt 10 rotates counterclockwise as shown in FIG. 1, respective yellow, cyan, magenta, and black toner images formed on the photoconductive members 20 installed in the respective image forming units 500 are sequentially superimposed on the intermediate transfer belt 10 at the above-mentioned primary transfer positions N1 as a color image. A transfer medium launched by the sheet-feeding device 31 is fed to the secondary transfer position N2 at a prescribed time from the pair of registration rollers 36 via the conveyance path 32.

The transfer medium launched to the secondary transfer position N2 receives secondary transfer of the color image at a section between the intermediate transfer belt 10 and the secondary transfer roller 34. Then, the transfer medium is conveyed to the fixing device 40. The toner image is fixed and the transfer medium is ejected on to the ejection sheet stack section 33 by the pair of sheet ejection rollers 38. Toner not transferred and remaining on the intermediate transfer belt 10 is scraped off by the cleaning member in the cleaning device 15.

Although not illustrated, plural toner bottles storing toner to be replenished to the respective image forming units 500Y to 500K are detached to the printer body 100. Numeral 19 denotes a manual sheet-feeding tray.

Now, details of the fixing device 40 included in the color printer of FIG. 1 is described with reference to FIG. 4. The fixing device 40 is freely attached to the printer body 100. A rectangular parallelepiped casing 41 is arranged in the fixing device 40. The casing 41 includes a long slender introduction inlet 42 and a long slender ejection outlet 43 opposing each other at the ceiling and bottom of the casing 41.

In the casing 41, a fixing roller 44 made of elastic material such as rubber is rotatively supported around a shaft 45 on one side of a transfer medium conveyance path extending between the slender introduction inlet 42 and ejection outlet 43. A force of a driving motor M is transmitted to and drives the shaft 45 of the fixing roller 44 counterclockwise. A heat-applying roller 46 including a void metal roller is rotatively supported around a shaft 47 arranged apart from the fixing roller 44 in the casing 41. The heat-applying roller 46 includes one or more heaters 48, such as a halogen heater, etc.

A heat resistant endless fixing belt 50 is wound around the fixing roller 44 and the heat-applying roller 46 is outwardly depressed by a tension roller 52 biased by a spring 51 from an inside. The heater 48 is arranged inside the heat-applying roller 46, but can be arranged outside the fixing belt 50. A heat generating layer can be arranged on the surface of the fixing belt 50 other than the heater while arranging an electromagnetic induction coil therearound.

Further, in the casing 41, a pressure applying roller 54 is freely supported around a shaft 53 on the other side of the transfer medium conveyance path and is depressed to the fixing roller 44 via the fixing belt 50, thereby a fixing nip N is created at a position on the transfer medium conveyance path. The pressure-applying roller 54 includes a void roller having a heater inside. A cleaning roller 56 pressure contacts the pressure-applying roller 54 and can be displaced in relation to the fixing roller 44. The cleaning roller 56 removes toner or sheet dust sticking to the surface of the pressure-applying roller 54, but is not necessarily employed.

Below the pressure applying roller 54, a plate like fixing section inlet guide member 57 is secured to the casing 41 in the vicinity of the introduction inlet 42 so as to form a transfer medium conveyance path. Above the pressure applying roller 54, a plate like fixing section outlet guide member 58 is supported inside the casing in the vicinity of the ejection outlet 43 so as to form a transfer medium conveyance path. At a position opposite to the fixing section outlet guide member 58 across the transfer medium conveyance path, a separation member 59 is supported. The separation member 59 is plate like or has a comb teeth member extending in parallel to an axis of the fixing roller 44 apart from the surface of the fixing belt 50.

Now, an exemplary secondary transfer device 60 is described with reference to FIG. 5 together with the fixing device 40 of FIG. 4. The secondary transfer device 60 includes a secondary transfer roller 34 freely rotatably arranged in the casing 61, and a plate transfer section inlet guide member 62, and a transfer section outlet guide member 63 secured to the casing 61. Thus, the secondary transfer device 60 is swingable between an operational position A and an open position B around a shaft 64 as a swinging center as shown by rigid and dotted lines. Thus, when a contacting section 65 contacts a positioning protrusion 66 (not shown in FIG. 4) of the fixing device 40, the secondary transfer device 60 is held at the operational position A.

Since when the secondary transfer device 60 swings and thereby the contact section 65 contacts against the positioning protrusion 66, and accordingly the secondary transfer device 60 is held at the operational position A, the secondary transfer device 60 and the fixing device 40 are directly positioned in relation to each other. Thus, a parallel degree therebetween can be kept without reference to a casing included in the printer body 100 suppressing accumulation of tolerance. Thus, precision of a relative positioning between the secondary transfer device 60 and the fixing device 40 can be increased at low cost. Occurrence of curls and winkle on a transfer medium as well as color deviation on a toner image can be suppressed. A contacting position is most preferably determined to minimize the accumulation of tolerance.

When the secondary transfer device 60 is positioned at the operational position A, a transfer medium is launched by the pair of registration rollers 36 in synchronism with a toner image on the transfer belt 10. Specifically, the transfer section inlet guide member 62 guides the transfer medium along the conveyance path 32 toward the secondary transfer position N2. Then, at the secondary transfer position N2, the toner image on the transfer belt 10 is transferred onto the transfer medium by the secondary transfer roller 34. The transfer section outlet guide member 63 guides the transfer medium into the fixing device 40 through the introduction inlet 42 after the image transfer process.

Figure 4:
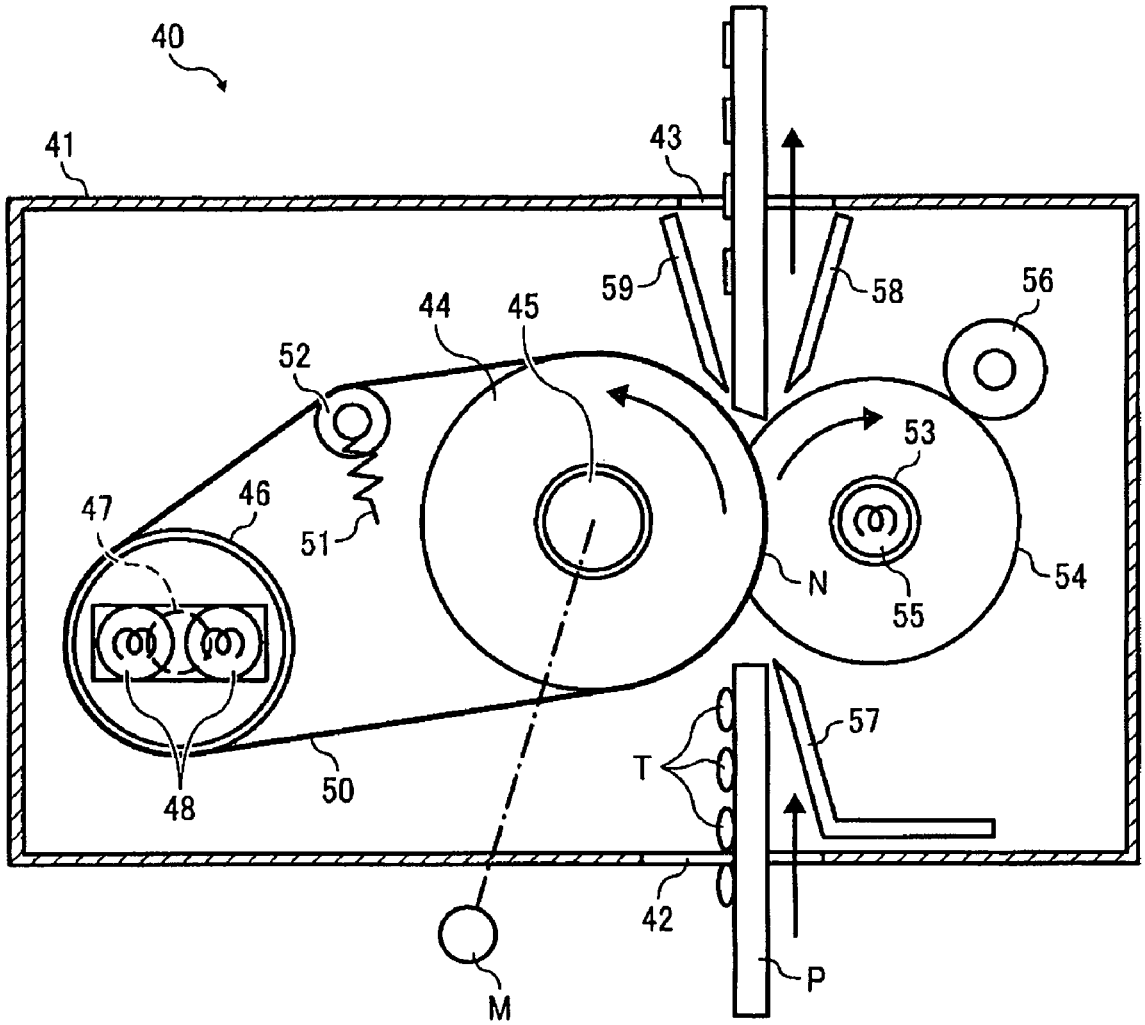
FIG. 4 illustrates an exemplary fixing device included in the color printer of FIG. 1.
Figure 5:
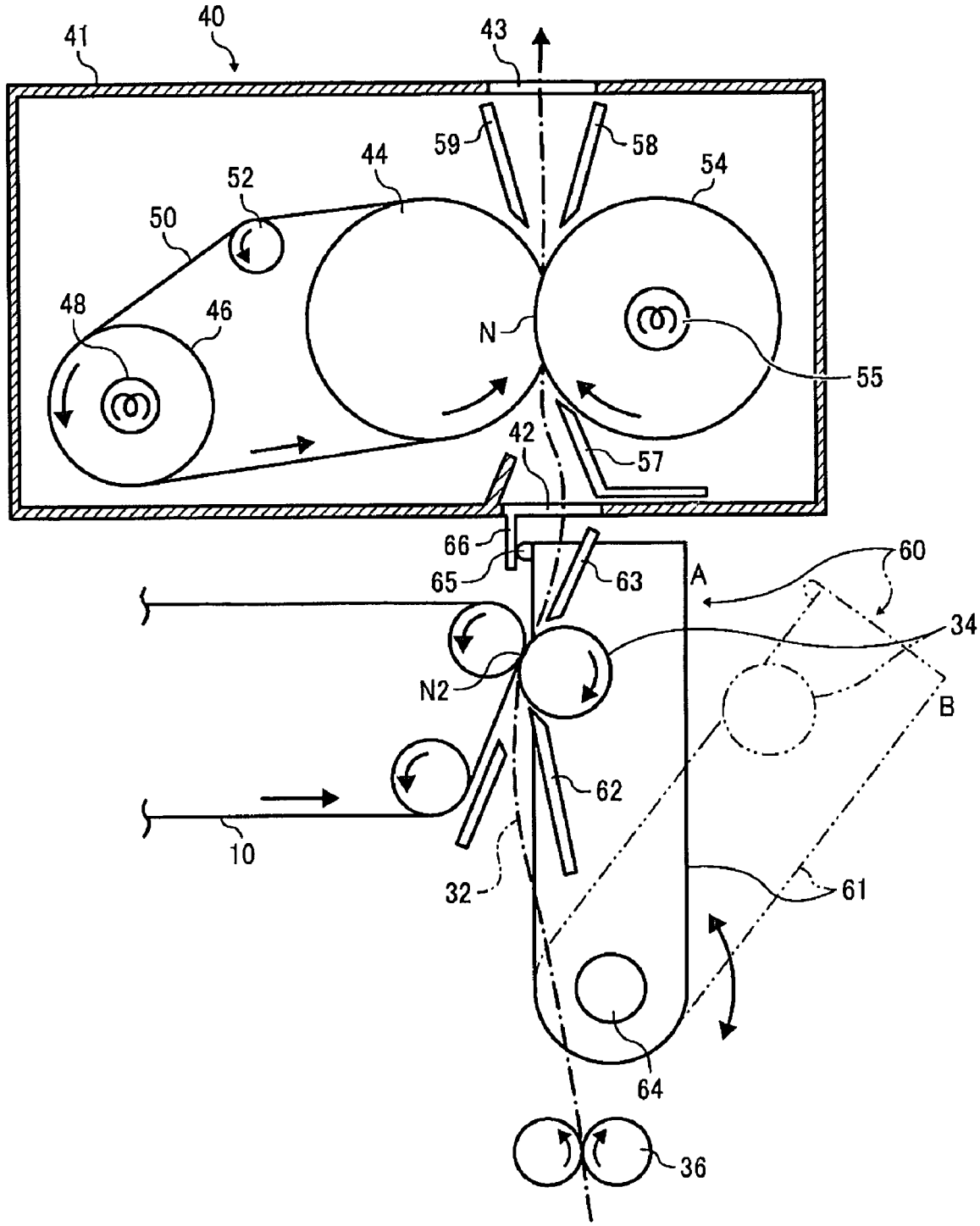
FIG. 5 illustrates an exemplary secondary transfer device and the fixing device of FIG. 4.

The transfer medium in the fixing device 40 guided by the fixing section inlet guide member 57 enters a fixing nip N and receives heat and pressure, thereby unfixed toner T is fixed onto the transfer medium as shown in FIG. 4. The transfer medium is separated by a separation member 59 from the fixing belt 50, and is guided by the fixing section outlet guide member 58, thereby being ejected from the sheet ejection outlet 43.

The above-mentioned transfer section outlet guide member 63 and the above-mentioned fixing section inlet guide member 57 are separately attached to the casings 61 and 41 of the secondary transfer device 60 and the fixing device 40, respectively. However, these guide members 63 and 57 can be integrally attached to one of the casings 61 and 41. The optimum conveyance path 32 can be formed if the separate type guide members are used. Whereas the integral type one is cost effective. The latter type is also advantageous such that a step or a gap between these guide members can be easily formed, because these guide members are positioned with reference to the secondary transfer device 60 and the fixing device 40, respectively.

Figure 6A:
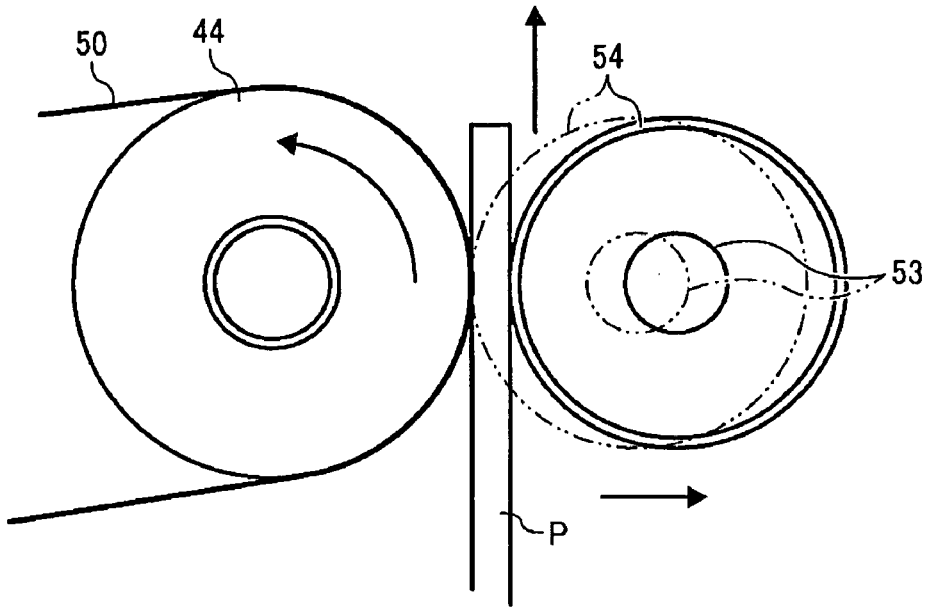
FIGS. 6A and 6B each illustrates an exemplary state of pressure applying roller when displaced in relation to a fixing roller.
Figure 6B:
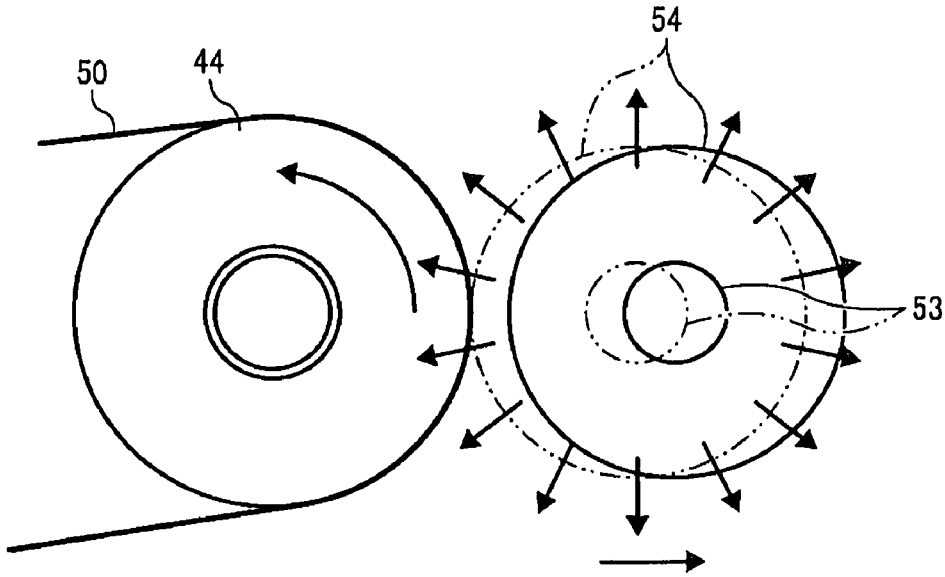

As shown FIGS. 6A and 6B, when thickness of a transfer medium varies as shown in FIG. 6A or the pressure applying roller 54 expands due to heat as shown in FIG. 6B, the shaft 53 is moved in left and right while being biased by a bias member, such as a spring, etc, against the surface of the fixing roller 44 via the fixing belt 50. Thus, the pressure applying roller 54 either approach or part from the fixing roller 44.

Figure 7:
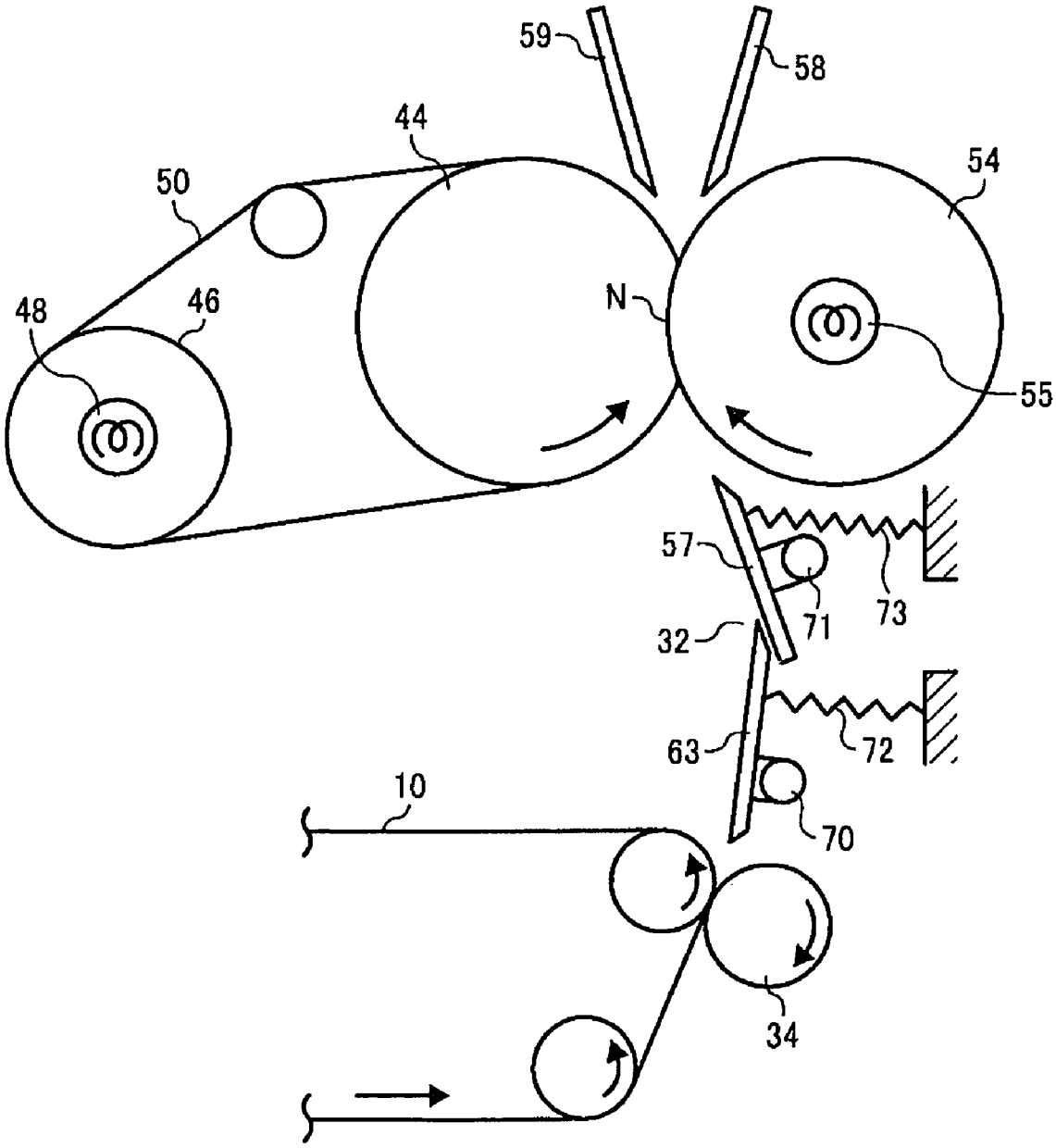
FIG. 7 illustrates a transfer section outlet guide member and a fixing section inlet guide member whose positions are freely adjustable according to another embodiment of the present invention.

Now, another embodiment capable of dealing with winkle and/or edge folding on a sheet is described with reference to FIG. 7. As shown, a transfer section outlet guide member 63 and a fixing section inlet guide member 57 are adjustably positioned. The transfer section outlet guide member 63 is freely rotatably supported around a shaft 70. Similarly, the fixing section inlet guide member 57 is freely rotatably supported around a shaft 71. Even though these guide members 63 and 57 are biased by springs 72 and 73, respectively. However, these springs can be omitted.

When winkle or edge folding occurs on a transfer medium, such a problem can be handled by changing a route of a conveyance path 32 for the transfer medium. Specifically, an angle of the fixing section inlet guide member 57 is appropriately changed to adjust a position thereof. Although not shown in the drawings, a fastening screw is arranged on the shaft 71 and the angle of the fixing section inlet guide member 57 is adjusted by loosening the fastening screw. By winding up the fastening screw, a position of the fixing section inlet guide member 57 is fixed after positioning. The positional adjustment for the transfer section outlet guide member 63 is similarly performed.

Now, a modification of the above-mentioned embodiment is described with reference to FIG. 8. As shown, the transfer section outlet guide member 63 and the fixing section inlet guide member 57 are mutually linked and their positions are freely adjusted. The transfer section outlet guide member 63 is freely rotatably supported around the shaft 70. The fixing section inlet guide member 57 is also freely rotatably supported around the shaft 71. These guide members 63 and 57 are biased by tension springs 72 and 73, respectively.

However, no fastening screw is provided to the shafts 70 and 71. Instead, a bias of the tension spring 73 is stronger than that of the tension spring 72. Thus, the transfer section outlet guide member 63 always contacts the fixing section inlet guide member 57. A solenoid 75 is linked to the fixing section inlet guide member 57 via a linkage 74.

When the solenoid 75 is turned on, the linkage 74 is pulled and moves rightward, the fixing section inlet guide member 57 swings counterclockwise around the shaft 71 while the transfer section outlet guide member 63 follows the fixing section inlet guide member 57 and swings clockwise around the shaft 70 from a position shown by a dotted line to a position shown by a solid line. Thus, the guide members 57 and 63 collectively conform a bending path.

In contrast, when the solenoid 75 is turned off, the fixing section inlet guide member 57 is returned clockwise and the linkage 74 is fully drawn by bias of the tension spring 73, and the transfer section outlet guide member 63 is pushed back counter clockwise, and is located at a position shown by a dotted line from that shown by a solid line.

The linkage 74 and the solenoid 75 adjust the positions of both of the guide members 57 and 63. However, a fine adjustment of the guide members 57 and 63 can be performed if a driving device including a motor, a cam, and a linkage is employed instead of the solenoid 75. A manual lever can be employed to manually adjust positions of the guide members 57 and 63.

Figure 8:
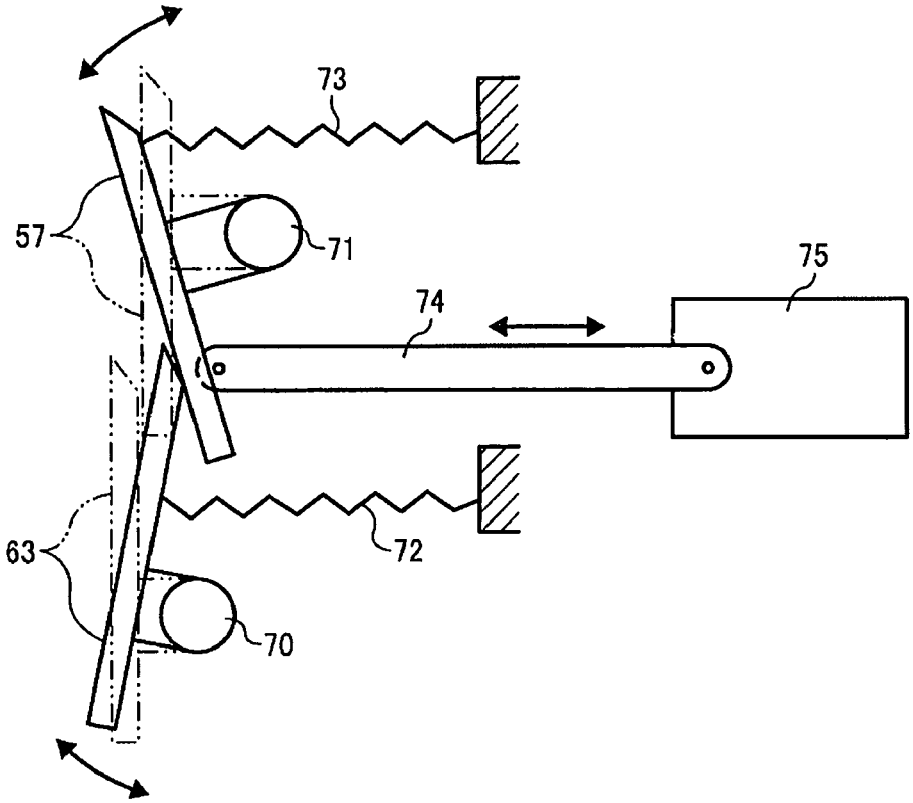
FIG. 8 illustrates a transfer section outlet guide member and a fixing section inlet guide member linked to each other so that their positions are freely adjustable according to yet another embodiment of the present invention.
Figure 9:
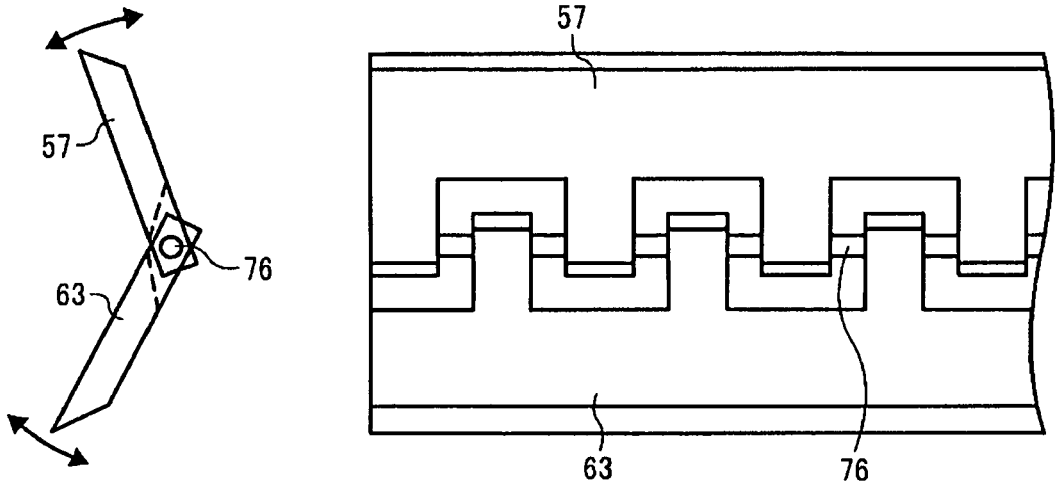
FIG. 9 illustrates an exemplary modification of the link guide member used in the other embodiment of FIG. 8.

In FIG. 8, the bias of the tension spring 73 is larger than that of the tension spring 72, and the transfer section outlet guide member 63 always contacts the fixing section inlet guide member 57. However, as shown in FIG. 9, one end of each of the transfer section outlet guide member 63 and the fixing section inlet guide member 57 is formed like comb teeth and engaged with each other to be freely rotatable around a mutual axis 76 extending through the engaging position.

Further, positions of the transfer section outlet guide member 63 and the fixing section inlet guide member 57 are preferably adjusted in accordance with a sheet feeding condition, such as a sheet feeding mode, e.g. a simplex mode, a duplex mode, etc., for printing or copying. For example, when the duplex mode is performed, since a transfer medium passing through the fixing device once is conveyed again to the fixing device, the transfer medium can cause curls before entrance to the fixing device again. However, when the curls are relatively large, the sheet edge is folded or winkle occurs. At this moment, since a position of the fixing section inlet guide member 57 is appropriately adjusted for conveying the transfer medium with the curls, sheet edge folding or the winkle can be suppressed. Specifically, when the curls with its non-image surface side being inside are relatively large, both of the guide members 57 and 63 are preferably moved to a position as shown by the dotted line in FIG. 8.

As the other sheet feeding condition, a difference in conveyance speed can be exemplified. Further, to change resolution or a finishing condition, a conveyance speed of the transfer medium is sometimes changed stepwise plural times, such as 222 mm/s, 125 mm/s, and 62.5 mm/s. In this situation, depending upon the conveyance speed of the transfer medium, a condition of a leading end of the transfer medium changes. Specifically, since the transfer medium carries charge after the transfer process, the transfer medium is conveyed sticking to the above-mentioned guide members 57 and 63. Thus, when the conveyance speed is relatively high, the transfer medium is conveyed with its leading end slightly floating. Whereas when the conveyance speed is relatively low, the transfer medium is conveyed sticking to the guide members 57 and 63. However, such a problem can be resolved by adjusting positions of the guide members 57 and 63. Specifically, when the transfer medium tends to stick, both of the guide members 57 and 63 are shifted.

Further, when the duplex mode is performed, the first surface (i.e., a surface on which an image is initially formed) is sometimes scraped. Then, by adjusting positions of the guide members 57 and 63, an image is not scraped.

Further, positions of the transfer section outlet guide member 63 and the fixing section inlet guide member 57 can be adjusted in accordance with a type of a transfer medium, such as a resin sheet, a coat sheet, a label sheet, an envelope, a backside blank sheet, a recycled sheet, a thickness, a rigidity of sheet, an electric resistance, a fineness, etc. The other various types of transfer mediums used by a user can be handled. In anyway, a prescribed number of positions of the guide members 57 and 63 are prepared, and optimum positions can be selected and set. A printer driver or a user, via an operation panel, can set such positions when a printer is used. Further, when a bland of a transfer medium is designated, the guide members 57 and 63 can be automatically shifted to optimum positions.

Further, the positions of the transfer section outlet guide member 63 and the fixing section inlet guide member 57 can be adjusted in accordance with environment where an image forming apparatus is installed and operated. Such an installation environment includes environment of usage of a printer or a copier, such as temperature, humidity, moisture of a transfer sheet, etc. When humidity is relatively high, the transfer medium tends to cause curls. Since a transfer condition changes in accordance with humidity, a charge amount also changes. When optimum positions of the guide members are provided, such wrinkle and edge folding can be suppressed. When the charge amount is relatively large, the guide members 57 and 63 are preferably shifted as shown by the dotted line in FIG. 8.

Further, the positions of the transfer section outlet guide member 63 and the fixing section inlet guide member 57 can be adjusted in accordance with an image condition of the transfer medium, such as an image area, photograph quality, etc. When the image area increases, an amount of charge on the transfer medium increases. Further, an amount of toner increases in the case of photograph, and affects the amount of charge. Since conveyance quality is mostly affected by the above-mentioned conditions when the duplex mode is performed, adjustment of the guide members 57 and 63 is effective.

In the earlier described embodiment, the transfer device 50 swings and pressure contacts the fixing device 30. In contrast, however, the transfer device 50 can be fixed and a contact section provided in the fixing device 30 can swing and contact a contacted section provided in the transfer device 50.

Figure 10:
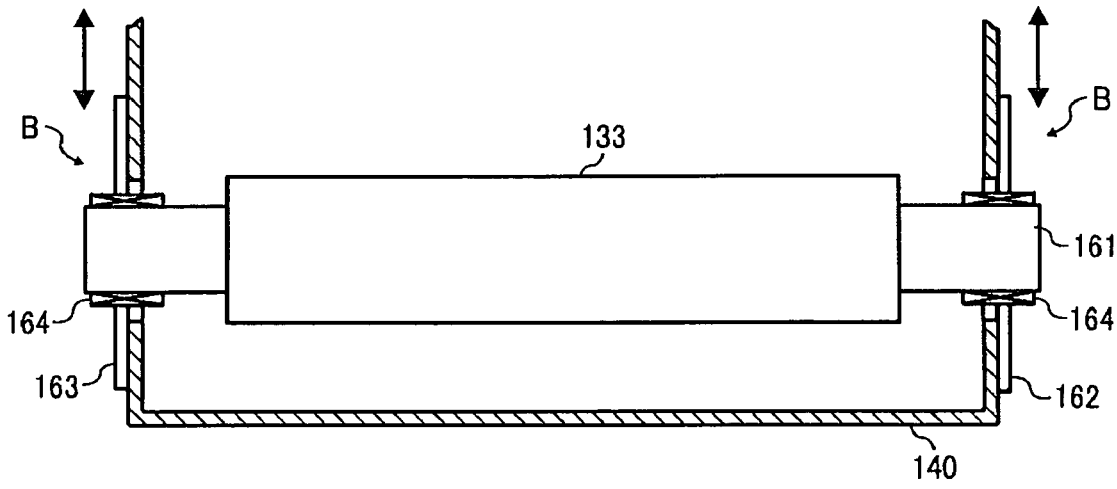
FIG. 10 illustrates still another embodiment showing an exemplary fine adjustment device for finely adjusting a parallel degree between a transfer nip and a fixing nip.

Now, a fine adjustment device B for finely adjusting a parallel degree between the transfer nip and the fixing nip N are described with reference to FIG. 10. As shown, only a position of the pressure applying roller 133 in the fixing device 130 is finely adjusted.

The pressure-applying roller 133 includes plural adjustment plates 162 and 163 attached to both ends of the roller shaft 161 via bearings 164, and are held by the casing 140 of the fixing device 130 via the adjustment plates 162 and 163. The adjustment plates 162 and 163 are connected to the casing 140 with screws and each includes plural holes so that an attachment position of the pressure-applying roller 133 can be adjusted. Specifically, the parallel degree of the pressure-applying roller 133 can be adjusted by screwing the adjustment plates down through a prescribed hole. By adjusting the position of the pressure-applying roller 133, conveyance of not only the sheet but also the fixing belt 136 can be stable. In FIG. 10, a contacted section 156 of the casing 140 is omitted.

Figure 11:
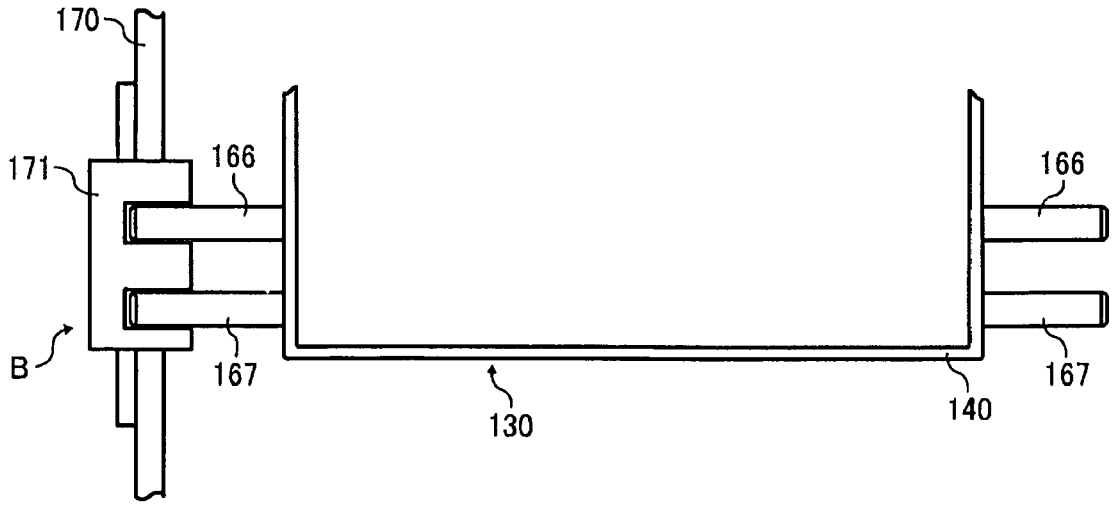
FIG. 11 illustrates an exemplary modification of the fine adjustment device of FIG. 10.

Now, a modification of the fine adjustment device B is described with reference to FIG. 11. As shown a parallel degree between the transfer nip and the fixing nip N by is adjusted by wholly moving the fixing device 130 in relation to the transfer device 150. The example of FIG. 10 is advantageous in view of a sheet and belt conveyance quality. However, few deconstruction and assembling operations are necessitated to adjust parts to be arranged in the fixing device 130. Whereas in this modification, the parallel degree adjustment for the sheet conveyance can be readily performed by providing the fine adjustment device B between the fixing device 130 and a supporting member that supports the fixing device 130 as shown in FIG. 11.

Figure 12:
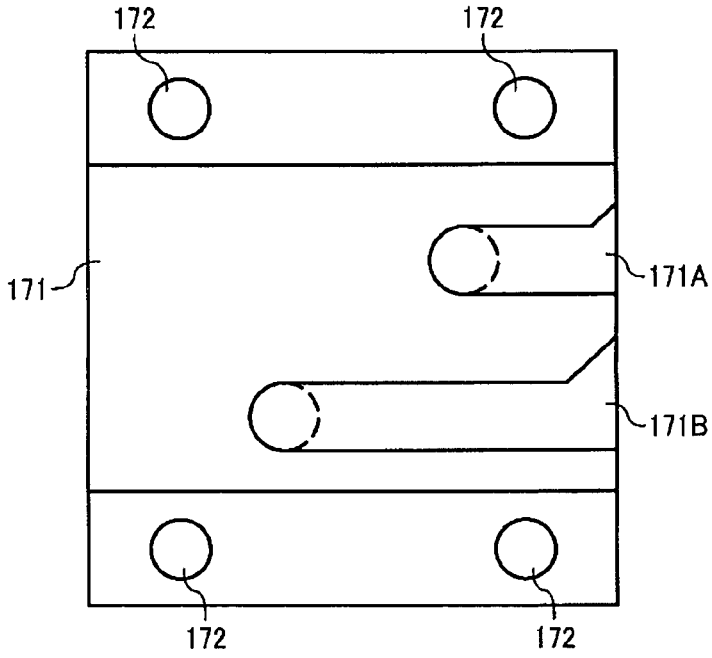
FIG. 12 is illustrates an exemplary positioning plate included in the fine adjusting device of FIG. 11.

Specifically, plural reference pins 166 and 167 protrude in parallel from both sides of the housing 140. As the supporting member, a body frame 170 of the image forming apparatus 100 is used. On the positioning plate 171 attached to the body frame 170, a pair of grooves 171A and 171B are formed for receiving the reference pins 166 and 167 and guiding the fixing device 130 when the fixing device 130 is attached to the body of the image forming apparatus 100 as shown in FIG. 12.

Then, by pressurizing the reference pins 166 and 167 inserted into the grooves 171A and 171B with lever like securing members, not shown, the fixing device 130 is supported and positioned by the body frame 170 via the positioning plate 171. The positioning plate 171 is firmly connected to the body with screws. However, since holes 172 formed on the positioning plate 171 have larger diameters than those of the screws, the positioning plate 171 can be secured after freely adjusting the position of the fixing device 130.

The fine adjustment device B can be arranged on either one side or both sides of the fixing device 130. When arranged only on the one side, the fine adjustment device B is preferably arranged opposite a side, in which a driving transmission gear train, not shown, is arranged for transmitting a driving force to the fixing device 130 therefrom. Because, if arranged on the gear train side, the gear train can be deformed by movement of the fine adjustment device B resulting in defective messing. Thus, the fine adjustment device B neither affects an operation of the driving transmission gear train nor causes defective messing. As a result, the fine adjustment device B can finely adjust the parallel degree between the transfer nip and the fixing nip N.

To easily adjust, a scale can be attached to an appropriate portion of the body frame 170 or an adjustment use jig can be employed. By connecting a driving device to the fine adjustment device B, automatic adjustment can be performed. Also as shown in FIG. 16, the contacted section 156 to be provided on the casing 140 is omitted.

Figure 13A:
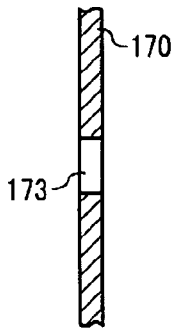
FIG. 13A is a cross sectional view of a body frame of the tandem type color printer, which supports the positioning plate.
Figure 13B:
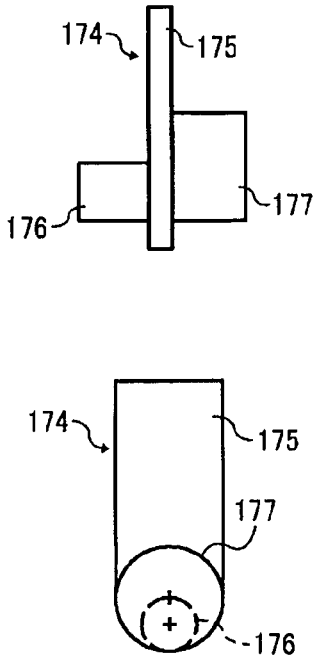
FIG. 13B is front and side views illustrating an exemplary adjustment lever fitting into the body frame and the positioning plate at its both sides.
Figure 13C:
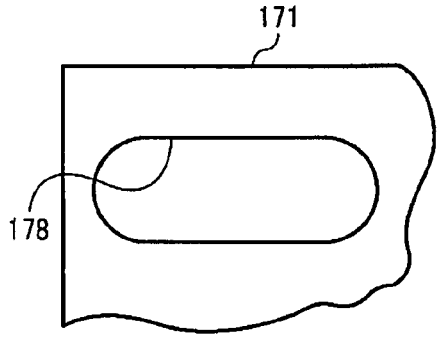
FIG. 13C is a partially enlarged view of the positioning plate.
Figure 14:
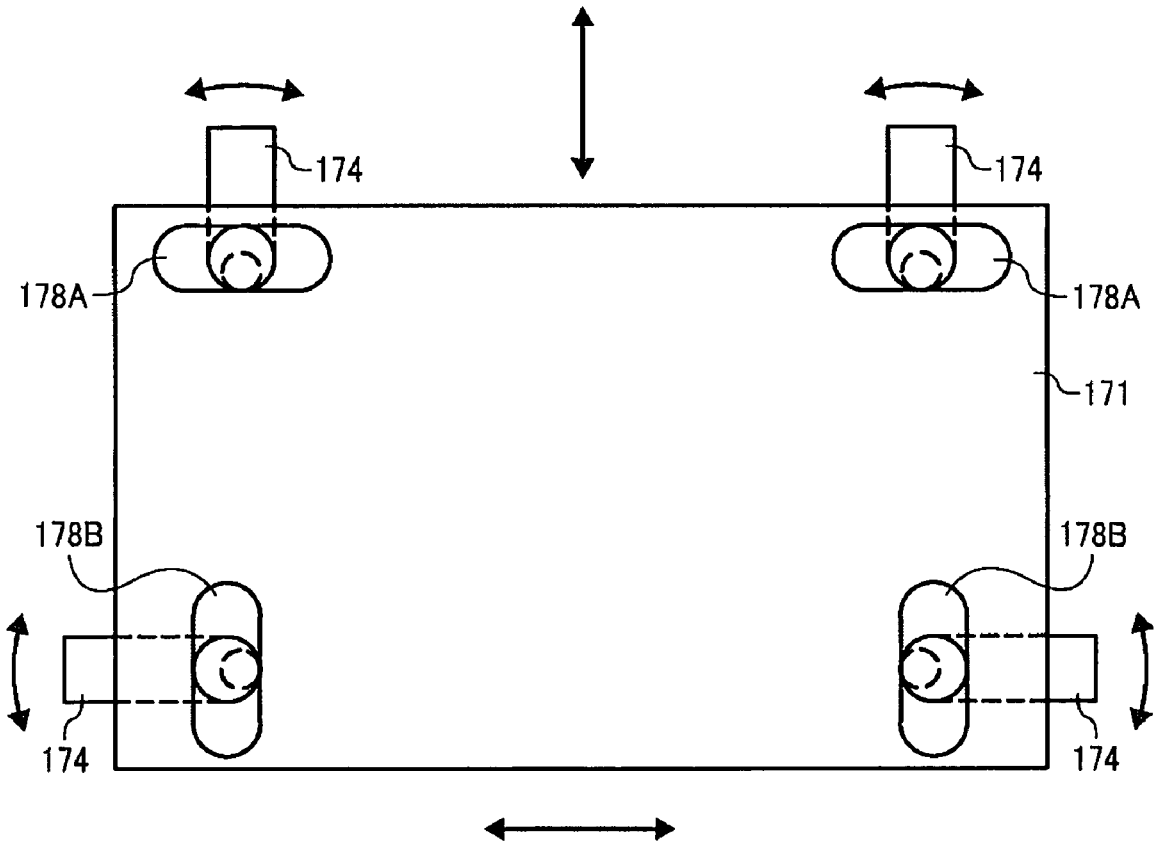
FIG. 14 illustrates exemplary state of the positioning plate when displaced during adjustment.

An exemplary adjustment operation of displacing a positioning plate 171 is now described with reference to FIGS. 13A to 13C and 14. As shown in FIG. 13A, a reference hole 173 is formed on the body frame 170. As shown in FIG. 13B, an adjustment lever 174 includes a reference convex 176 and a fitting convex 177 on both surfaces being eccentric with each other at one end of a plate section 175. As shown in FIGS. 13C and 14, lateral and vertical ellipse holes 178A and 178B are arranged on right and left sides of upper and lower ends of the positioning plate 171.

Then, the reference convex 176 enters the reference hole 173, while the fitting convex 178A enters the ellipse hole 178. The adjustment lever 174 inserted into the lateral ellipse hole 178A is arranged with the other end of the plate section 175 directing upward, while the adjustment lever 174 inserted into the vertical ellipse hole 178B is arranged with the other end of the plate section 175 directing left and right. By swinging each of the adjustment levers 174 around the reference convex 176, a position of the fixing device 130 is changed and adjusted in a direction as shown by an arrow in FIG. 14. Thus, a fine adjustment device B can finely adjust a parallel degree between the transfer nip and the fixing nip N separately both in parallel and/or perpendicular to the surface of the transfer sheet.

Adjustment of the parallel degree causes different advantages in accordance with the parallel and vertical directions. Specifically, the parallel degree in the conveyance direction affects winkle and a linearity of an image. The parallel degree in the vertical direction affects scraping of an image. Since erroneous adjustment causes unexpected side effects, the above-mentioned separate adjustment is preferable.

Figure 15A:
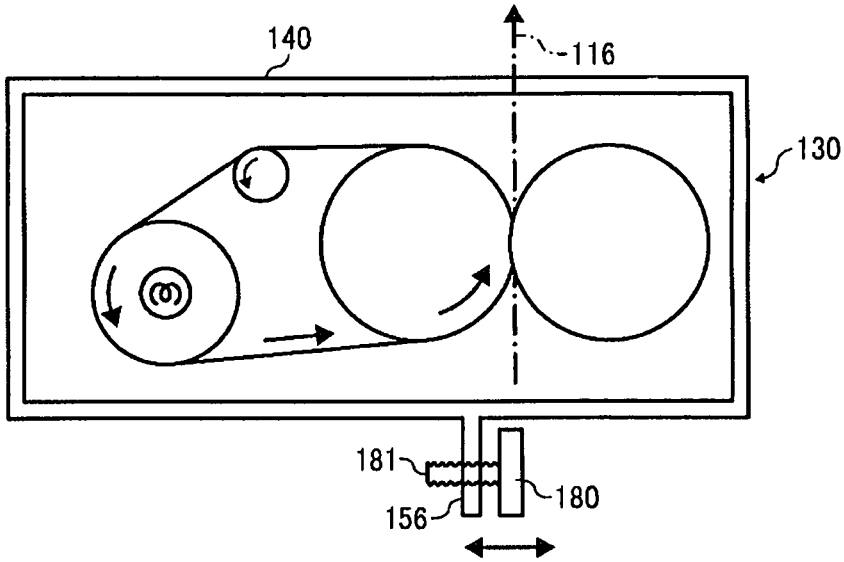
FIGS. 15A and 15B are front and side views illustrating exemplary state of a transfer device when a fine adjustment of a parallel degree of a transfer nip and a fixing nip is executed by moving and adjusting the transfer device in relation to a fixing device.

Now, another exemplary fine adjustment of a parallel degree of the transfer nip and the fixing nip N is described with reference to FIGS. 15A and 15B.

In this embodiment, fine adjustment is executed in a vertical direction to the surface of the sheet while moving and adjusting the transfer device 150 in relation to the fixing device 130.

Specifically, a contacted section 156 is provided on the casing 140 of the fixing device 130 and includes a fine adjustment member 180 adjustable with a screw. The above-mentioned transfer device 150 contacts the contacted section 156 via a contacting section 155 and the fine adjustment member 180. By moving and adjusting a position of the fine adjustment member 180 with the screw, the parallel degree between the transfer nip and the fixing nip N can be adjusted, and parallel adjustment in the vertical direction to surface of the sheet becomes easier. The fine adjustment member 180 can be provided on the contacting section 155.

Figure 15B:
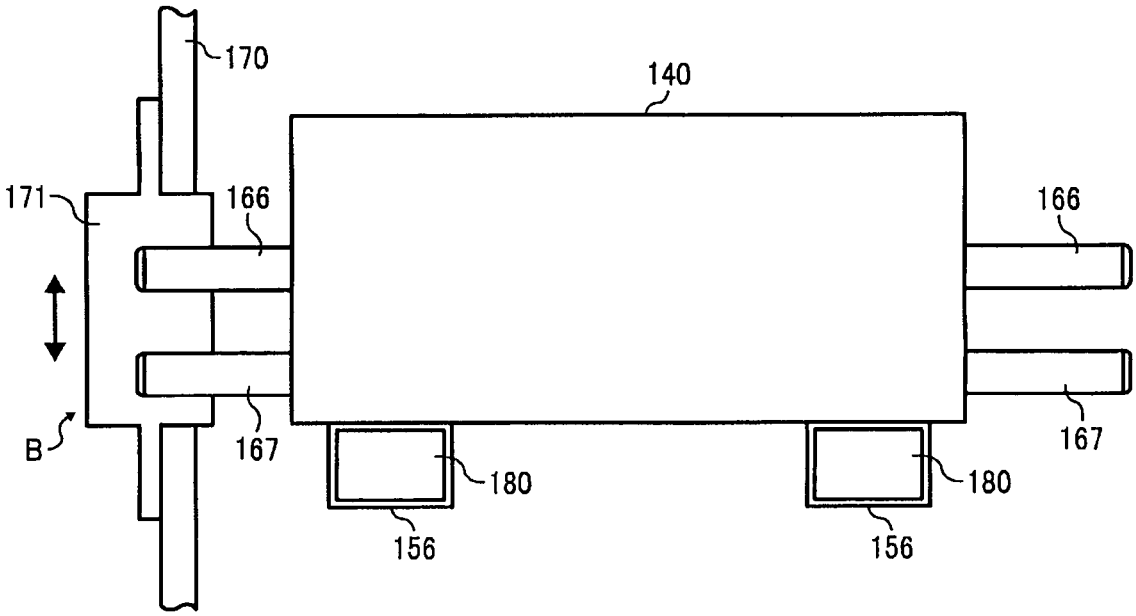

Thus, fine adjustment of the parallel degree of the transfer nip and the fixing nip N in parallel to the surface of the sheet can be executed by moving a positioning plate 171 upwardly or downwardly between the fixing device 130 and a supporting member such as a body frame 170 supporting the fixing device 130 as shown in FIG. 15B.

Numerous additional modifications and variations of the present invention are possible in light of the above teachings. It is therefore to be understood that within the scope of the appended claims, the present invention may be practiced otherwise that as specifically described herein.

What is claimed is:

1. An image forming apparatus comprising:

a transfer device including a transfer roller and configured to transfer a toner image onto a recording medium when the recording medium passes through a transfer nip formed on the transfer roller;

a fixing device including a fixing roller, the fixing device being configured to fix the toner image onto the recording medium when the recording medium passes through a fixing nip formed on the fixing roller; and a fine adjustment device configured to finely adjust parallel degree between the transfer nip and the fixing nip;

wherein one of the transfer device and the fixing device includes a contacting section, and the other one of transfer device and the fixing device includes a contacted section, and wherein relative positioning between the transfer device and the fixing device is determined when the contacting section contacts the contacted section; wherein said parallel degree is finely adjusted in the direction vertical to the surface of the recording medium by contacting the contacting section to the contacted section.

2. The image forming apparatus as claimed in claim 1, wherein the parallel degree is finely adjusted in the direction in parallel to the surface of the recording medium between the fixing device and the supporting frame.

3. The image forming apparatus as claimed in claim 1, wherein the fixing device is supported by a supporting frame, and the fine adjustment device is located between the fixing device and the supporting frame.

4. The image forming apparatus as claimed in claim 1, further including a driving force transmitting device configured to transmit a driving force to the fixing device, wherein said fine adjustment device is disposed on the opposite side of the drive force transmitting device.

5. The image forming apparatus as claimed in claim 1, wherein the parallel degree is finely adjusted in both directions in parallel and vertical to the surface of the recording medium.

* * * * *